United States Patent [19]

Lisowski

[11] 4,194,459

[45] Mar. 25, 1980

[54] BOATS HARDWARE SYSTEM

[75] Inventor: Walter E. Lisowski, Addison, Ill.

[73] Assignee: Helm Products, Inc., Addison, Ill.

[21] Appl. No.: 834,416

[22] Filed: Sep. 19, 1977

Related U.S. Application Data

[63] Continuation-in-part of Ser. No. 761,793, Jan. 24, 1977, abandoned.

[51] Int. Cl.[2] ..... B63B 9/00

[52] U.S. Cl. ..... 114/221 R; 248/230; 9/1.7

[58] Field of Search ..... 114/221 R, 218; 9/1.1, 9/1.5, 1.6, 1.7; 115/17; 224/36; 24/135 K, 249 LS, 285, 262, 204; 248/62–65, 67.7, 74 R, 200–202, 205 R, 214, 230, 229, 221–226.5, 316 A, 279, 418, 454, 456, 475 R, 475 B, 514, 515, 518, 521, 534, 503, 507, 538, 539, 541; 74/471

[56] References Cited

U.S. PATENT DOCUMENTS

| | | | |
|---|---|---|---|
| 2,370,748 | 3/1945 | O'Donnell | 24/249 LS |
| 2,536,071 | 1/1951 | McClung | 224/36 |
| 2,600,852 | 6/1952 | Coots | 74/471 |
| 2,946,546 | 7/1960 | Pokorny et al. | 248/534 |
| 3,270,994 | 9/1966 | Machan et al. | 248/229 |
| 3,304,035 | 2/1967 | Davis | 248/541 |
| 3,640,498 | 2/1972 | Aleks | 248/230 |
| 3,929,310 | 12/1975 | Peham | 248/226.5 |
| 3,943,585 | 3/1976 | Leral | 9/1.7 |
| 3,945,544 | 3/1976 | Walker et al. | 248/223.4 |

FOREIGN PATENT DOCUMENTS

| | | | |
|---|---|---|---|
| 514211 | 2/1955 | Italy | 224/36 |

*Primary Examiner*—Edward R. Kazenske
*Assistant Examiner*—Jesus D. Sotelo
*Attorney, Agent, or Firm*—Laff, Whitesel & Rockman

[57] ABSTRACT

A boats hardware system—especially, although not exclusively designed for pleasure boating—involves massive clamping parts fashioned from a plastic, which is light enough to float. The parts are shaped and proportioned to fit over and be clamped to a rail of a boat. Clamping is preferably accomplished by large head nuts which may be fully tightened responsive to finger pressure. A rubber or other friction forming plug or screw head may be used to increase the friction or immobilize the clamp on the boat rail so that it will not turn about the rail. For convenience of description the term "anti-torque" is used hereinafter to mean this non-turning immobilization. The various parts may be used together in different combinations to make a system which easily fits into place, even when bulky items are installed by one person. An important advantage of the invention is its ability to be mounted on a boat without requiring either an undue amount of time or any special tools.

6 Claims, 18 Drawing Figures

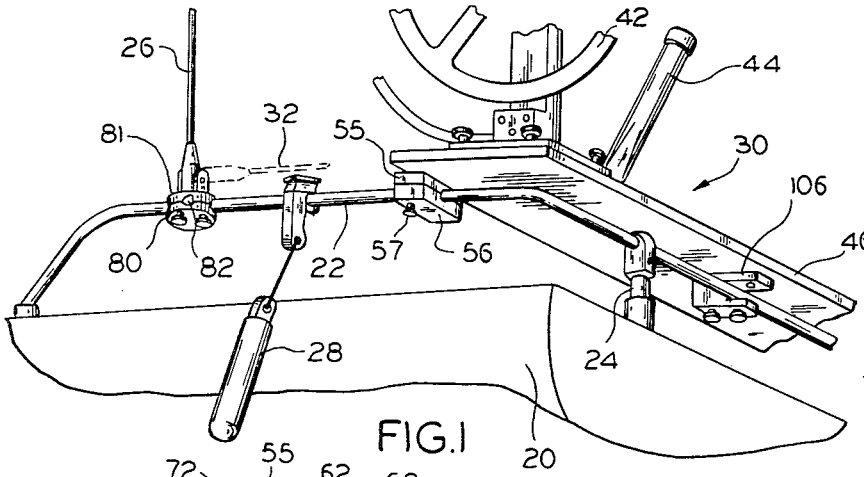
FIG.1
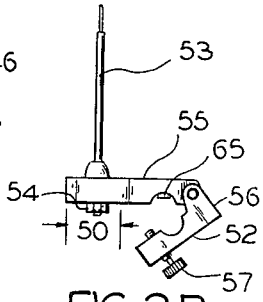
FIG.2B
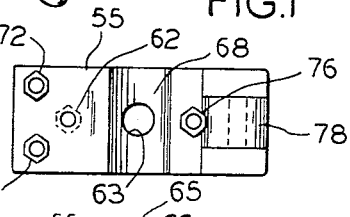
FIG.3A
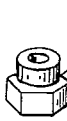
FIG.3C
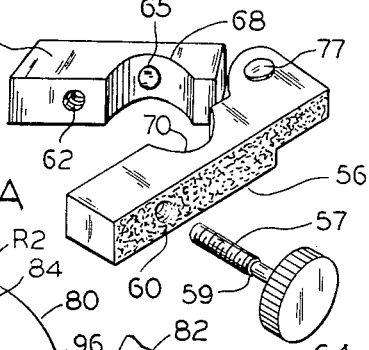
FIG.2A
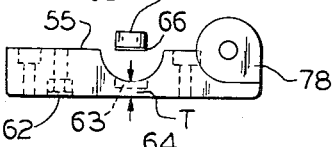
FIG.3B
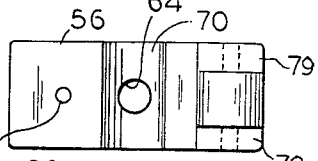
FIG.4A
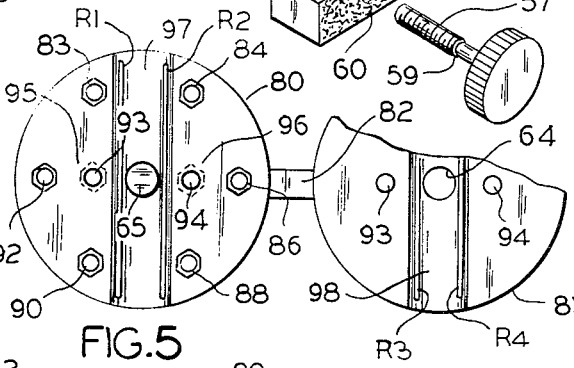
FIG.5
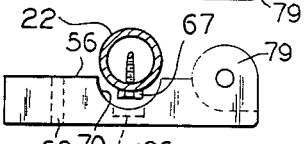
FIG.4B
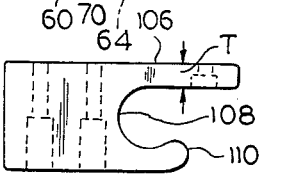
FIG.9A
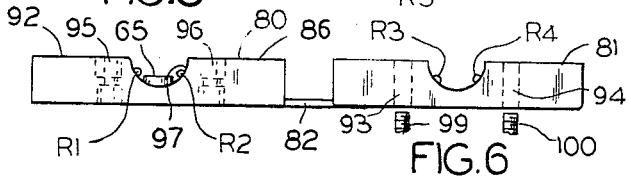
FIG.6
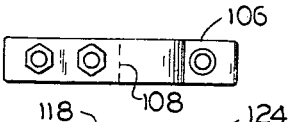
FIG.9B
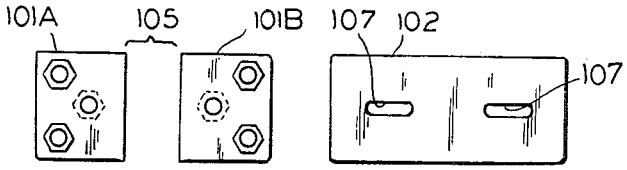
FIG.7A
FIG.8A
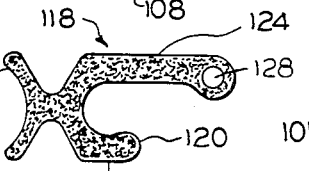
FIG.10A
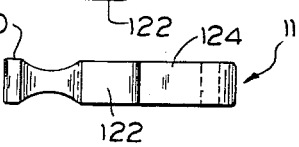
FIG.10B
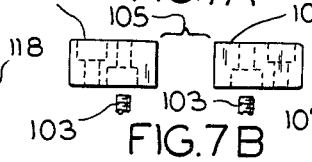
FIG.7B
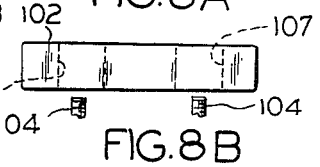
FIG.8B

BOATS HARDWARE SYSTEM

This is a continuation-in-part of my co-pending application Ser. No. 761,793, filed Jan. 24, 1977 now abandoned.

This invention relates to boats hardware systems and more particularly to hardware especially—although not exclusively—well-adapted for use on pleasure boats.

Pleasure boating has grown substantially over the recent years, expanding into many fields, such as runabout boating, hobby fishing, rental, charter boating, or the like. As the popularity of boating usage has expanded, special equipment of new design has mushroomed. For example, a recent boom in citizen's band (CB) radio usage has led to an installation of electronic equipment, sometimes extremely sophisticated equipment, and accessories, such as antennas. The proliferation of boating equipment has led to a hodgepodge of boating hardware wherein each manufacturer has its own distinctive components. If a boat user installs all the available equipment, he will be drilling holes, placing screws, clamps, bolts, connectors and the like all over his boat. In fiberglass boats, the holes for these attachments may start hull cracks which can grow at alarming speed. Also, these piecemeal installations require substantial amounts of time to mount and dismount the equipment, which should be done every time the boat is taken out.

Boats are constantly exposed to the elements, to spray, and to high humidity which causes rust, corrosion, and general deterioration. Therefore, boats hardware is conventionally made of solid brass with suitable multi-layered plating, which is very expensive.

Pleasure boats are conventional tied up in more or less public places where expensive equipment may be vandalized, stolen, or abused. Hence, it is prudent to remove expensive gear, but this is time-consuming and, if dropped overboard, it sinks, and is lost. Also, pleasure boats do not have large crews, so that one person usually performs all docking and similar functions.

Because of these and similar problems, there are needs for specialized hardware for boats. It is not practical and sometimes not possible to use non-marine hardware on boats. For example, CB antennas and antenna mounts designed for use on trucks cannot be used on boats, because the trucks use a so-called ground plane antenna which requires large, nearby areas of metal (the truck body). Accordingly, there is a need for a system of standardized hardware which may be used uniformly to mount equipment, quickly and easily on a boat.

Thus, an object of the invention is to provide new and improved means for and methods of mounting any of many different kinds of equipments on a boat and, in particular, on a pleasure boat. In this connection, an object is to provide hardware which may be used to quickly and easily attach or remove equipment on boats. Here, an object is to enable a user of expensive equipment to remove it from his boat without requiring an extensive and time-consuming dismantling procedure.

Another object of the invention is to provide a weatherproof system of boat hardware.

Yet another object is to provide boat hardware which will float, at least before attachments are added thereto.

Still another object is to provide boat hardware which may be installed or removed without requiring any special tools. In particular, an object is to provide means for installing and removing fairly expensive equipment such as CB electronic gear, fishing gear, and the like, which a boater would likely use on almost every trip and which he would not want to leave exposed on an unguarded boat between trips.

A further object is to provide a more universal mounting which is more rigidly attached to a boat's rail than has heretofore been possible with previously-existing hardware clamps.

A still further object is to provide a general purpose system which may mount virtually any accessory gear on a boat, even that which must be relocated quickly and often.

In keeping with an aspect of the invention, these and other objects are accomplished by providing massive clamp parts fashioned from a plastic which is light enough to float. The clamp parts are shaped and proportioned to fit over and be clamped, at any convenient location, on the rail of a boat. Clamping is accomplished by large head nuts which may be fully tightened or removed responsive to finger pressure. A special rubber plug or other friction-forming material or pan head screw is included to make the clamp attachment to the rail a more rigid anti-torque connection so that it will not turn about the rail.

The nature of a preferred embodiment of the invention will be best understood from a study of the attached drawing, wherein:

FIG. 1 shows the stern of an exemplary pleasure boat, using the inventive hardware system;

FIG. 2A shows a perspective view of an inventive hinged clamp;

FIG. 2B is a side elevation which shows a modification of the clamp of FIG. 2A, wherein an extension is provided for mounting separate structures, such as antennas;

FIGS. 3A and B include a plan view and a side elevation view (respectively) showing one of the piece parts forming the hinged clamp of FIGS. 2A,B;

FIG. 3C is a perspective view which shows a nut insert which may be used to secure the various screws in the plastic;

FIGS. 4A,B includes similar views showing a second series of the piece parts forming the hinged clamp of FIGS. 2A,B;

FIG. 5 includes a plan view showing a pair of the piece parts for a circular platform mount;

FIG. 6 is a side elevation view which shows the piece parts of the circular platform mount;

FIGS. 7A,B includes a plan view and a side elevation showing a clamp for a rectangular boat rail mount;

FIGS. 8A,B includes similar views showing the other piece part for use with the members of FIGS. 7A,B for clamping onto a rectangular boat rail;

FIGS. 9A,B are a side elevation and plan view which shows a hook mount which may be used to position equipment in conjunction with any of the other mounts; and FIGS. 10A,B are a side elevation and plan view which shows an alternative hook that may be used when a screw-tightened mount is not required.

The stern of a boat 20 of FIG. 1 is a general and stylized showing of almost any part of almost any boat and is not intended to suggest a limitation upon usage of the inventive hardware system. As here shown, the boat comprises a hull, preferably made of fiberglass, with a rail 22 mounted on the stern thereof.

Typically, the rail may be a bright, highly-polished, plated pipe or tube attached to the hull by any suitable number of vertical supports, as at 24, for example. At the present time these rails are almost always ⅞" diameter; although a few are 1" diameter and still fewer are wooden rails of rectangular cross section. Of course, other sizes and shapes may also be provided. In any event, one size pipe accommodates the vast majority of pleasure boats, and three sizes accommodate virtually all pleasure boats. These rails are often appearance items which give pride and prestige to boat owners. Therefore, they are readily available in a great variety so that some kind of attractive railing may be permanently mounted almost anyplace on a boat where gear is desired.

In order to avoid having to make new holes or holes dedicated to specific gear in the boat hull 20, the inventive hardware system contemplates making all attachments to these rails. More particularly, as here shown, exemplary rail-mounted gear might comprise a CB antenna 26, a boat bumper 28, and fishing gear 30. The characteristics of a marine CB antenna is that it is not a ground plane antenna and does not use the same form of mounting brackets that a truck, for example, would use. Often it is foldable between two positions, one (26) of which is upstanding, for broadcast and reception, and the other (32) is folded down so that a weather cover may be placed over it. Because the antenna is a long lever, it exerts strong turning forces upon its clamp 80,81, even when the source of such force is only the rocking motion of the boat at rest in the waves.

The characteristic of the bumper 28 is that it should be hung over the side of a boat approaching a dock or other boat. Often, it is now known where the bumper 28 will be required until the point of possible impact is perceived as the boat is about to strike the dock or another boat. Thus, the bumper must be detached from one place and hung from another place very quickly, and with a minimum of fumbling.

The characteristic of the fishing gear 30 is that it has a substantial number of relatively large parts, which makes it awkward to maneuver. For example, as here shown, there is a deep troller 42, and a plurality of rod holders (one of which is seen at 44) mounted on a board 46, which often is polished mahogany or some other easily-damaged surface. Here, it is desirable to lower one side or edge of the board onto the rail in a self-positioning manner so that it is only necessary to hook one side and clamp the other.

In all of these and other uses, it is desirable to attach and detach gear without ever marring the appearance or scratching through a protective coating on the rails. Also, the hardware must be strong enough not to become fatigued responsive to internal working as the boat pitches and rolls. Finally, there is no problem of the clamps rotating about the boat rail when they are rigidly mounted at a plurality of positions on the bottom of a board, such as board 46. However, if an isolated clamp is separately mounted, as at 80, for example, the clamp must resist turning about the rail. This is especially true when the clamp supports a relatively long object, such as an antenna, which exerts substantial leverage upon the clamp.

Accordingly, the invention contemplates a use of massive plastic parts which are molded from a material which works internally to attenuate vibrations and preclude fatigue. The material should be light enough to float in water even when it contains bolts, nuts and perhaps other associated materials, also. The material should be dimensionally stable over more than the entire climatic range of usage likely to be encountered during the lifetime of the hardware. It should not cold-flow or creep. The material should be soft enough so that it will not scratch or mar the surface of the rail and yet hard enough so that it will firmly and rigidly grip the rail to support the mounted gear. All hooks should have a capture detent so that they may easily snap over the rail, without inadvertently slipping off. All clamps should be controlled by screws having large heads or handles that may be tightened or loosened with finger pressure. A material which has all of these characteristics is polypropylene.

Briefly, FIG. 2A shows in perspective and FIGS. 3A,B, 4A,B show in plan and side views, one example of a basic clamp which may be used in any of many different configurations. As shown in FIG. 2A, the clamp has a flat side which is adapted for attachment to the bottom of a box, board, or other device, such as the bottom of the fishing gear support board 46 of FIG. 1, for example. The surfaces of the clamp are preferably textured so that it will not easily slip out of the user's fingers, when wet.

In FIG. 2B, essentially the same clamp has an upper jaw projection 50 which extends beyond the end of lower jaw 52. The projection 50 includes a hole or other means for receiving and supporting a suitable mounting bolt 54. For example, as here shown, the bolt 54 is attached to the bottom of an antenna 53; however, it could also be attached to any other suitable device.

When the jaws 55, 56 of the clamp are placed over rail 22, and closed upon themselves, a bolt 57, with a large head extends through a hole 60 in the lower plastic jaw 56 and into a nut 62 embedded in the upper plastic jaw 55. Preferably, the bolt 57 has contours 59 so that it is captured within and cannot be removed from the hole 60 in the lower jaw 56. For example, hole 60 may include a dam which is smaller in diameter than the threads of bolt 57. Thus, the threads of bolt 57 may be forceably turned into the dam to lead the screw through the hole 60. A reduced neck 59 turns easily inside the hole 60 in order to keep the bolt 57 from slipping from the hole 60. Thus, the bolt 57 cannot inadvertently be removed and lost. The bolt 57 may have a conventional screw thread, a quarter-turn bayonet mount, a cam, or the like.

The details of upper jaw 55 are seen in FIGS. 3A,B and of lower jaw 56 are seen in FIG. 4A,B. A generally cylindrical recess 63,64 is formed in the two parts 55,56, respectively. A friction means in the form of a rubber plug 65 (FIG. 3B) is shaped and dimensioned to fit snugly into the hole 63 and to project slightly beyond the surface of the clamp member 55. A suitable pressure sensitive adhesive is coated on the bottom of the rubber plug 65 and covered by a release paper 66. When the paper 66 is peeled off and the plug 65 is pressed into the hole 63, the plug is secured in position. The pressure-sensitive adhesive is sealed to the unit when the clamp is fastened onto the rail. An alternative embodiment uses a pan head, sheet metal screw 67 which may be driven into the rail 22. The recess 64 exactly fits over the screw 67.

Each of the two jaws 55,56 includes a semi-circular cove 68,70 which fits snugly over approximately one-half of the rail 22. There is a hole 63 receiving the plug 65 at substantially the central points in each of the coves 68,70. Thus, when upper jaw cove 68 is placed over the rail, the cove 70 on the lower jaw 62 may be brought up so that bolt 57 may be tightened to attach the clamp parts 55,56 with the rail 22 captured within the coves 68,70. The rubber plug 65 provides friction between the clamp and rail while the pan head screw 67 completely immobilizes the clamp on the rail. The selection between these two embodiments (i.e., the rubber plug 65 or pan head screw 67) depends primarily upon the attachment to the clamp. The greater leverage may require the use of pan head screw 67 while a lesser leverage may require the rubber plug 65.

The nut for the clamp bolt 57 is seen at 62 and in FIG. 3C. Three other nuts 72,74,76 are also embedded in the plastic to receive bolts (not shown) which pass through the board 46. Each of these nuts includes a hexagonal section which slips into a similarly-shaped recess in the plastic. The nut includes a threaded passageway for receiving any screws or bolts which may be used for attaching the parts together. An advantage of this configuration is that the nut is captured in the plastic so that no wrench or other tool is required to hold the nut while the screw or bolt is being turned. Since the user-applied bolt 57 has a large head, there is no need for a special tool to turn it either.

The right-hand ends of jaws 55,56 contain mating hinge sections 78,79. A bolt or hinge pin 77 (FIG. 2A) interconnects these two hinge sections 78,79.

Accordingly, screws or bolts may be fitted through any suitable base for equipment to be mounted on a boat and then turned into nuts 72,74,76 to attach one clamp section 55 to such equipment so that it may be mounted on a boat rail. The surface of each of the mounting hardware system elements is flat and smooth so that it universally fits against almost any equipment, such as the board 46, for example. The lower jaw section 56 may swing down to open or up to close the jaws 55,56. Then, the large head bolt 57 may be turned into nut 62 to clamp the jaw assembly together and the board 46 to the rail.

FIGS. 5 and 6 show a similar clamp device which may be used when a structure has a circular base and which is especially useful in connection with relatively heavy items which may be independently mounted, such as searchlights, or antennas, for example. FIG. 1 shows a simple CB antenna 26 with a circular base. The antenna may stand upright or may fold downwardly, as at 32. Hence, there is a need to select rotary orientation for the base so that, in the folded-down position, the antenna is in a safely-protected position. Otherwise, the folded antenna might project into a walkway, for example, might be walked on or tripped over.

Accordingly, the embodiment of FIGS. 5,6 includes a pair of circular plates 80,81, integrally joined together by a strap 82 so that the plates may not become lost from each other. A plurality of bolt holes 83-92 are distributed around the periphery of the plates, with a suitable angular offset (here 60°) between the adjacent holes. Of course, there could be any other suitable offset angle. This way, the antenna 26, for example, may be placed on the base plate in any of many different rotary orientations. The upper plate 80 includes a pair of holes 95,96 which may be bolted into two opposed holes 93,94 of plate 81 to complete the clamp assembly. The bolts 99,100 for making this assembly may be the same as bolt 57. As with the rectangular plate of FIGS. 3A,B; 4A,B, the plates 80,81 include a pair of coves 97,98, one containing a rubber plug 65 and the other containing a hole for receiving the head of a pan head screw, if it is used. The coves provide means for receiving the ship's rail 22. The two plates 80,81 may also be hinged together as shown at 78,79 (FIGS. 3A,B;4A,B).

Positioned within each cove are a plurality of ribs R1,R2 and R3,R4 which provide a more precise fit over the rail, when the cove and the rail have cross sections which do not fit precisely. For example, the plastic may shrink in a distorted manner, as the plastic cools. Or the rail may not be perfectly circular in cross section. Since the ribs are made of plastic and since they have a smooth exterior surface, they do not bite into or mar the surface of the rail.

FIGS. 7A,B;8A,B are similar to both FIGS. 3A,B-;4A,B and FIGS. 5,6, except that it is for uses in installations on a rectangular ship's rail. FIGS. 7A and 7B show two separate sections 101A and 101B which may be bolted to a device, such as the bottom of board 46, with a rectangular ship's rail captured between them in space 105. (The space 105 is defined by and between two opposed blocks which are seen in FIGS. 7A,B.) These two clamp halves 101A, 101B are secured to the bottom of board 46, for example, by means of large head bolts 103.

The spacing 105 may be any which is convenient for receiving and capturing the rectangular ship's rail. The mating clamp part 102 of FIGS. 8A, 8B is merely a flat plate 102 which has a pair of elongated holes 107,107. These holes are long enough to mate with corresponding holes in FIGS. 7A,7B, despite minor positioned adjustments to accommodate variations of space 105 to fit different ships' rails. Part 102 is bolted to parts 101A, 101B by means of bolts 104,104 which are similar to bolt 57 of FIG. 2B.

Sometimes, it is handy to have an indexing mechanism (such as a hold-down hook) to help position gear before it is clamped into place. For this positioning hook, the structure of FIGS. 9A,B may be used. Here, there is a simple U-shaped member 106 having a cutout cove 108, for fitting over the ship's rail. If desired, a detent may be provided at 110 to snap over the rail. Of course, the detent may also be omitted if it is not desired or an opposite or somewhat funnel shape may be provided to serve as a guide. The thickness T, at the top of the cove 108 in the hook 106, equals the thickness T on the top of the previously-described plates (FIGS. 3A,B-;6A,B;8A,B). Thus, the hook of FIGS. 9A,B may be placed on the board 46 adjacent the edge running parallel to the rail 22. This way, a person installing board 46 merely has to capture the rail 22 by sliding it into the hook 106 and then to lay the board down on the side extensions of the rail. Also, when the hinged clamp of FIG. 2A is used, the lower jaw may be designed to hang down at a specific angle to help guide and longitudinally position the board 46, as it slips into position.

FIGS. 10A,B show another hook 118, which is somewhat similar to the hook of FIGS. 9A,B. A detent 120 is formed on the short end 122 of the hook 118 so that it tends to snap over and be captured on the rail 22. The long end 124 includes a mounting hole 128. Opposite the bight of the hook is a section 130 fashioned to be gripped between two fingers, or the thumb and one or more fingers. Again, at least the gripping portions are textured to enable the hook to be gripped more securely when the user's hands are wet. Thus, the hook may be pushed over or pulled from the rail, quickly and easily. Of course, anything may be hung from or mounted in the hole 128. However, it is particularly thought that a boat bumper may be used.

It will be seen that I have provided a system for mounting any of many different kinds of devices on boats, especially pleasure boats. There is no need to make holes in the boat which may be sources of leakage or places where cracks may start. The system is extremely quick and easy to use so that there is much less temptation to leave expensive gear mounted on a boat while it is unattended in a public place. Moreover, the various parts of the system may be mixed in different ways to accommodate a great variety of different items.

The invention may employ any suitable material to construct the elements in the hardware system. However, I prefer to use a material which is light enough to float in water, at least before any substantial equipment is attached to it, so that it will not be lost if dropped overboard. Especially, it should be a moldable plastic material. Also, the material should have a wide latitude of temperature limits, little or no brittleness at the extremity of its temperature limit, a substantial tensile strength, a low level of water absorption, and substantial rigidity.

Acceptable materials may be selected from the following table, with polypropylene preferred:

| | Linear Polyethylene | Polypro-propylene | Polymethyl-pentene |
|---|---|---|---|
| Temperature Limit °C. | 120 | 135 | 175 |
| Specific Gravity | 0.95 | 0.90 | 0.83 |
| Tensil Strength, psi | 4000 | 5000 | 4000 |
| Brittleness Temperature, °C. | −100 | 0 | — |
| Water Absorption, % | <0.01 | <0.02 | <0.01 |
| Flexibility | rigid | rigid | rigid |

Polyphenylene sulfide (PPS) is a crystalline polymer having a symmetrical, rigid backbone chain consisting of recurring para-substituted benzene rings and sulfur atoms. This chemical structure is responsible for the high melting point (550° F.), good chemical resistance, thermal stability, and fire resistance of the polymer. There are no known solvents below 375° to 400° F. The polymer is characterized by high stiffness and good retention of mechanical properties at elevated temperatures. Substantial increases in these properties are realized by the addition of fillers, especially glass. Mechanical properties of PPS are unaffected by long-term exposure in air at 450° F.

The inertness of PPS to a wide variety of organic solvents and to aqueous inorganic salts and bases makes for outstanding performance as a corrosion-resistant coating.

Polypropylene is a thermoplastic material which consists of an ordered arrangement of repeating propylene monomer units. During the polymerization cycle, special catalysts result in the formation of a chain-like configuration in which each monomer unit becomes fixed to the preceding unit. The product so structured is identified as isotactic polymer. Its spatial regularity and the close packing of adjacent chains yields a crystalline macrostructure. The polymerization process parameters are generally adjusted to maximize the amount of isotactic polymer which usually accounts for more than 90% of the product. The remainder consists of polymer with random spatial configuration. This portion of the product is atactic polymer, and forms an amorphous macrostructure.

Chemical resistance of polypropylene is good and is optimized by maximizing crystallinity in the polymer. The polymer is resistant to solutions of inorganic salts and mineral acids and bases, and most organic chemicals.

An optimum 40% filler addition display a four-fold increase in flexural modulus over the unfilled polymer—values to 900,000 psi are reported. The higher resistance to deformation provides a related improvement in heat-deflection temperature; a 50° to 80° F. rise is realized. Glass fibers, reinforcing material, have made possible grades with flexural modulus in excess of one million psi. Impact resistance enhancement and retention of stiffness at elevated temperatures also are characteristic.

Those who are skilled in the art will readily perceive how to modify the system. Therefore, the appended claims are to be construed to cover all equivalent structures.

I claim:

1. A hardware system for boats which resists torque tending to rotate said hardware around a rail comprising a hinged pair of opposing massive plastic discrete unitary members, said opposing members including mounting means distributed around the periphery thereof, whereby a device may be mounted on one of said opposing members, each of said discrete members having a single straight semi-circular cove consisting of a single smooth internal bore with no branching channels formed across a width of said plastic unit, said straight cove being shaped and dimensioned to fit over a correspondingly shaped exclusively straight section of a boat's rail, friction means comprising a rubber-like plug embedded in a hole located at substantially the central point of the bottom of said cove for creating torque-resisting friction between said massive plastic members and said boat's rail, and clamping means comprising a bolt with a large diameter head which can be tightened by hand without requiring tools for clamping said rail in said cove with a force which compresses said plug between said members and said rail, said bolt extending through both of said members, thereby securing said members on said rail wherein at least one smooth longitudinal rib means is formed in said cove to more precisely fit the cove to a rail, said rib means forming a section which gives a customized fit for said cove if the rail has a cross section that does not exactly match the cross section of the cove, whereby the rib means fill the space between said cove and said rail but do not bite into or mar the rail.

2. The hardware system of claim 1 wherein said opposing members have a hinge on one side of said rail and said finger-tightened bolt on the other side of said rail.

3. The hardware system of claim 1 wherein one of said opposing members includes an elongation extending over the other opposing member with said mounting means on said elongation.

4. The hardware system of claim 1 wherein said massive plastic member is made of a material which is light enough to float in water.

5. The hardware system of claim 1 wherein the surface of said plastic member is textured to facilitate gripping while the member is wet.

6. The hardware system of claim 1 wherein said clamping means comprises a pair of bolts for attaching said opposing members together on opposite sides of said coves, and said friction means further comprises a recess formed in one of said members and a screw fitting into said ship's rail, said screw having a head which fits into said recess.

* * * * *

UNITED STATES PATENT AND TRADEMARK OFFICE

CERTIFICATE OF CORRECTION

PATENT NO. : 4,194,459

DATED : March 25, 1980

INVENTOR(S) : Walter E. Lisowski

It is certified that error appears in the above-identified patent and that said Letters Patent are hereby corrected as shown below:

Column 1, line 35, "conventional" s/b --conventionally--

Column 3, line 34, "now" s/b --not--

Signed and Sealed this

*Fifteenth* Day of *July 1980*

[SEAL]

*Attest:*

SIDNEY A. DIAMOND

*Attesting Officer*

*Commissioner of Patents and Trademarks*